US007637501B2

(12) United States Patent
Akiyama et al.

(10) Patent No.: US 7,637,501 B2
(45) Date of Patent: Dec. 29, 2009

(54) DOCUMENT FEEDING DEVICE AND DOCUMENT READING APPARATUS WITH OPENING UPSTREAM AND DOWNSTREAM GUIDE MEMBERS

(75) Inventors: Mamoru Akiyama, Nishiyatsushiro-gun (JP); Motoaki Nakayama, Chuo (JP); Tetsuya Noda, Minami-Alps (JP)

(73) Assignee: Nisca Corporation, Minamikoma-Gun, Yamanshi (JP)

( * ) Notice: Subject to any disclaimer, the term of this patent is extended or adjusted under 35 U.S.C. 154(b) by 0 days.

(21) Appl. No.: 12/078,676

(22) Filed: Apr. 3, 2008

(65) Prior Publication Data

US 2008/0246208 A1 Oct. 9, 2008

(30) Foreign Application Priority Data

Apr. 5, 2007 (JP) ..... 2007-099651

(51) Int. Cl.
*B65H 5/06* (2006.01)

(52) U.S. Cl. ..... 271/273; 399/124; 399/125; 399/380

(58) Field of Classification Search ..... 271/273, 271/264; 399/124, 125, 367, 377, 379, 380
See application file for complete search history.

(56) References Cited

U.S. PATENT DOCUMENTS

2005/0127598 A1* 6/2005 Nagura ..... 271/264

FOREIGN PATENT DOCUMENTS

| | | | |
|---|---|---|---|
| JP | 06156776 A | * | 6/1994 |
| JP | 09086722 A | * | 3/1997 |
| JP | H09-086722 | | 3/1997 |
| JP | 2003-319131 | | 11/2003 |

* cited by examiner

*Primary Examiner*—Patrick H Mackey
*Assistant Examiner*—Gerald W McClain
(74) *Attorney, Agent, or Firm*—Manabu Kanesaka

(57) ABSTRACT

A document feeding device includes an upstream guide member that forms an upstream side of a document conveying path along which a document is guided from a sheet feeding tray to a platen, and a downstream guide member located between the upstream guide member and the platen. The document feeding device has a guide moving mechanism that slidably moves the downstream guide member away from an opposite guide member located opposite the downstream guide member upon a pivoting operation of the upstream guide member. Consequently, even if the document conveyed toward the platen is, for example, inappropriately conveyed to cause jamming, the document can be easily removed without being damaged.

11 Claims, 5 Drawing Sheets

DOCUMENT FEEDING DEVICE AND DOCUMENT READING APPARATUS WITH OPENING UPSTREAM AND DOWNSTREAM GUIDE MEMBERS

BACKGROUND OF THE INVENTION AND RELATED ART STATEMENT

The present invention relates to a document feeding device and a document reading apparatus comprising the same. More particularly, the present invention relates to a structure in the document feeding device which removes an inappropriately conveyed document.

A copier, a facsimile machine, a scanner apparatus, and the like comprise a document feeding device which delivers documents set on a sheet feeding tray, one by one, and which automatically feeds each of the documents with images onto a platen.

The document feeding device of this kind generally comprises a document conveying path through which each of the documents set on the sheet feeding tray is fed to a sheet discharging tray via the planar platen provided on a top surface of a main body of an image forming apparatus. The document conveying path often has a bent portion, and is thus formed substantially like a letter U, in order to discharge the document from the sheet feeding tray to the lower sheet discharging tray via the platen.

A guide cover is provided on the document conveying path and comprises a plurality of rollers that nips and feeds out the document. The guide cover is attached to a side plate so that the guide cover can be opened and closed using one end thereof as a support point. The guide cover can thus be opened to allow the removal of a document inappropriately conveyed on the document conveying path such as a jammed document, or to allow a maintenance operation such as cleaning to be performed.

With regards to means for removing the jammed document, Japanese Patent Laid-Open No. 9-86722 discloses a configuration in which the guide cover is opened to cancel the compression (nipping) of all rollers arranged on the document conveying path. Furthermore, Japanese Patent Laid-Open No. 2003-319131 discloses means for canceling the nipping of, among all the plurality of rollers on the document conveying path, a roller located immediately in front of the platen.

As shown in these conventional examples, the plurality of rollers arranged on the document conveying path is composed of a driving roller located inside the document conveying path and a driven roller located outside the document conveying path and abutting against the driving roller. The driven roller is attached to the guide cover, which covers the document conveying path. Thus, opening the guide cover allows the nipping between the driving roller and the driven roller to be easily cancelled. On the other hand, a part of the document conveying path which is located at a position immediately in front of the platen has only a small space. Thus, the nipping between the rollers arranged in this part may not be sufficiently cancelled. In particular, the part of the conveying path which is located at the position immediately in front of the platen has guide members that allow the document to travel along the conveying path in order to minimize the inaccuracy of reading of the image from the document. The guide members are arranged so as to have a gap with the minimum width that allows one sheet to pass through along the conveying path in order to prevent the document to be fed to the platen from being out of track.

If the document being conveyed is jammed, the nipping between the rollers can be cancelled by opening the guide cover. However, since the guide member is fixed to the part of the conveying path which is located at the position immediately in front of the platen, a leading end portion of the document may be caught in the gap, which allows the document to pass through. Thus, even when the nipping between the rollers is cancelled, the document may not be easily removed completely. In this condition, an attempt to forcibly remove the document may cause the leading end portion of the caught document to be torn. The leading end portion of the document may remain on the platen instead of being removed.

It is therefore an object of the present invention to provide a document feeding device which reliably guides a document to an image reading portion and which comprises a canceling configuration allowing the easy and reliable removal of the inappropriately conveyed document.

Further objects and advantages of the invention will be apparent from the following description of the invention.

SUMMARY OF THE INVENTION

The present invention contemplates a document feeding device having an upstream guide member that forms an upstream side of a document conveying path along which a document is guided from a sheet feeding tray to a reading platen. Further, a downstream guide member, located between the upstream guide member and the reading platen reading the document, is provided to form a conveying surface that is continuous with a top surface of the reading platen. The upstream guide member is configured to pivotally move in a direction in which the document conveying path is opened.

The document feeding device has a guide moving mechanism that slidably moves the downstream guide member away from an opposite guide member located opposite the downstream guide member in conjunction with a pivoting operation of the upstream guide member. The downstream guide member, located upstream of the reading platen, can thus increase the size of a space in a part of the conveying path which is located upstream of and close to the reading platen, in conjunction with an opening operation of the upstream guide member. When the size of the space in the part of the conveying path which is located upstream of and close to the reading platen is thus increased, even if the document conveyed toward the reading platen is, for example, inappropriately conveyed to cause jamming, the document can be easily removed without being damaged.

DESCRIPTION OF THE PREFERRED EMBODIMENT

Figure 1:
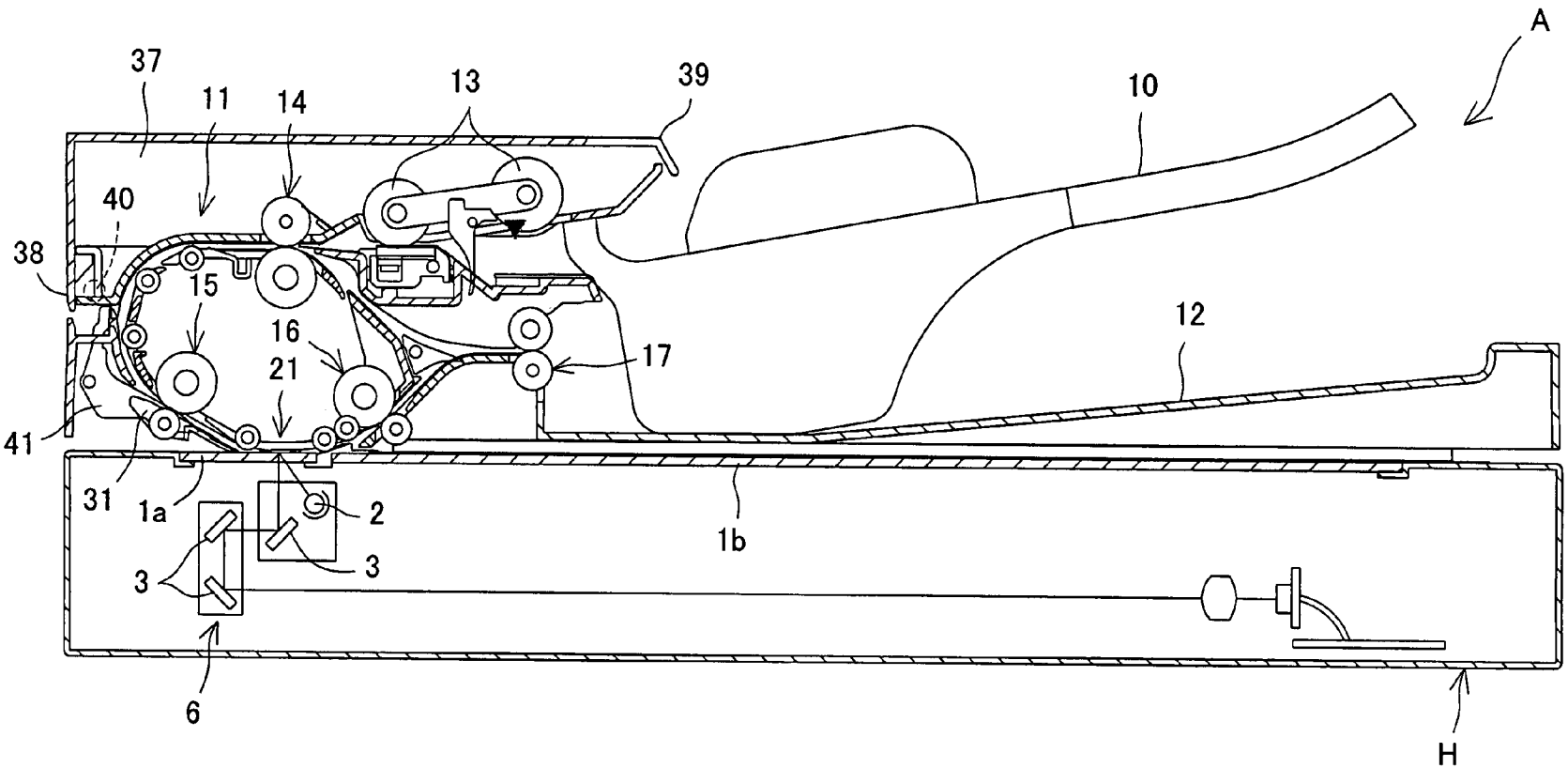
FIG. 1 is a sectional view showing the entire configuration of a document reading apparatus comprising a document feeding device according to the present invention.

With reference to the drawings, description will be given of a preferred embodiment of a document reading apparatus comprising a document feeding device. As shown in FIG. 1, a document feeding device A is placed on a document reading apparatus main body H for use. The document reading apparatus main body H executes a process of reading images from documents like a copier, a scanner apparatus, or the like. The document reading apparatus main body H has a first platen 1*a* provided on a top surface thereof and having a horizontal surface that allows documents conveyed by the document feeding device A one by one to be consecutively read, and a second platen 1*b* provided on the top surface thereof and having a horizontal surface through which stationary documents such as books are read.

An image reading unit 6 provided in the document reading apparatus main body H, shown in FIG. 1, comprises a light source 2 that irradiates a document conveyed onto the platen 1*a* with lamp light, a group of a plurality of mirrors 3 which guides reflection light from the conveyed document in a predetermined direction, a lens that converges the reflection light guided by the mirror group 3, and a CCD for photoelectric conversion. The image reading unit 6 can thus sequentially read images from documents passing over the platen 1*a*.

The document feeding device A comprises a sheet feeding tray 10 on which a plurality of documents is set, a document conveying path 11 along which each of the documents delivered from the sheet feeding tray 10 is conveyed onto the platen 1*a* in the document reading apparatus main body H, and a sheet discharging tray 12 that houses the document having passed over the platen 1*a*.

A plurality of rollers 13, 14, 15, 16, and 17 is disposed on the document conveying path as means for conveying the document from the sheet feeding tray 10 to the sheet discharging tray 12 via the platen 1*a*. The rollers are composed of delivery roller 13 that delivers the documents from the sheet feeding tray 10 one by one, first sheet feeding roller 14 that feeds the delivered sheet to the document conveying path 11, second sheet feeding roller 15 located upstream of and close to the platen 1*a*, first sheet discharging roller 16 located downstream of and close to the platen 1*a*, and second sheet discharging roller 17 located at an inlet of the sheet discharging tray 12.

Figure 2:
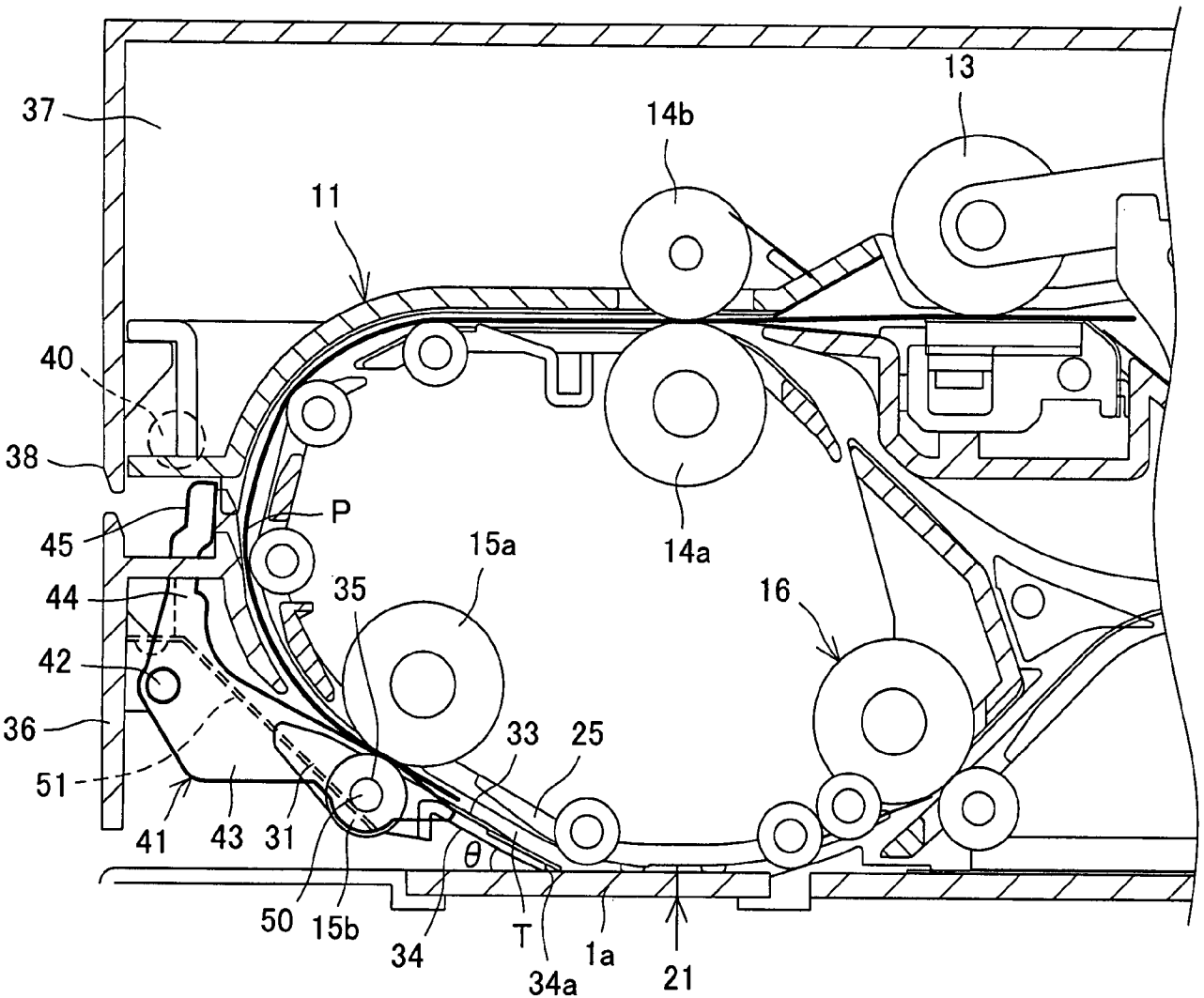
FIG. 2 is a sectional view of an essential part of the document feeding device.

As shown in FIG. 2, the document conveying path 11 comprises an upstream conveying path along which a document P is conveyed to a document reading position 21 (specifically, the position where the image reading unit 6, disposed below the platen 1*a*, reads the document P) while being bent, and a downstream conveying path along which the document P having passed through the document reading position 21 is conveyed.

A part of the upstream conveying path 11 from the first sheet feeding roller 14 to the platen 1*a* via the second sheet feeding roller 15 is bent so as to smoothly feed the document P having been delivered from the sheet feeding tray 10, onto the platen 1*a*. The first sheet feeding roller 14 is composed of a first driving roller 14*a* located inside the upstream conveying path and a first driven roller 14*b* located outside the upstream conveying path and compressed (nipped) by the driving roller 14*a*. The second sheet feeding roller 15 is composed of a second driving roller 15*a* located inside the upstream conveying path and a second driven roller 15*b* located outside the upstream conveying path and compressed (nipped) by the driving roller 15*a*. The delivery roller 13 and the first driven roller 14*b* are provided in a guide cover 37. The guide cover 37 is opened to cancel the nipping between the first driven roller 14*b* and the first driving roller 14*a*. The second driven roller 15*b* has a leaf spring 51 that biases a rotating shaft 50 of the second driven roller 15*b* toward the second driving roller 15*a*. The leaf spring 51 allows the second driven roller 15*b* to be nipped by the second driving roller 15*a*.

The document P conveyed by the first and second sheet feeding rollers 14 and 15, passes through the gap T between an opposite guide member (guide plate) 25 constituting a part of the document conveying path 11 and guide members 31 provided below and opposite the guide plate 25. The document P is then fed out onto the platen 1*a*. The gap T is set to have a width that allows one document to pass through. In FIGS. 1 and 2, motors that rotate the first driving roller 14*a* and the second driving roller 15*a* are omitted.

The guide members 31 are located so as to be movable away from the guide plate 25 in conjunction with the operation of separating the second driven roller 15*b* from the second driving roller 15*a* to cancel the nipping, the second driven roller 15*b* and the second driving roller 15*a* constituting the second sheet feeding roller 15. As shown in FIG. 2, the guide member 31 is supported by a shaft so as to be rotatable with respect to the second driven roller 15*b*. The guide member 31 comprises a rotation supporting portion (shaft hole) 35 penetrated by the rotating shaft 50 of the second driven roller 15*b*, a guide surface 33 located opposite the guide plate 25, and a bottom surface 34 that faces a top surface of the platen 1*a* so that the guide surface 33 lies opposite the guide plate 25 via the gap T. The guide surface 33 has a leading end portion 34*a* abutting against the platen 1*a* to form a guide angle θ to the platen 1*a* which angle is substantially equal to the inclination of the guide plate 25.

The second driven roller 15*b* is rotatably attached to one end of guide moving means (lever member) 41 provided on a side plate 36 of the document feeding device A. The lever member 41 is formed of a plate-like member and has a central portion constituting a rotating support point 42 rotatably supported by the side plate 36. The lever member 41 is shaped substantially like a letter V and has a lower arm portion 43 extending downstream from the rotating support point 42 in a document conveying direction and to which the second driven roller 15*b* is attached, and an upper arm portion 44 extending upstream from the rotating support point 42 in the document conveying direction. The lever member 41 configured as described above is provided so as to transmit an operation associated with the opening or closing of the guide cover 37 to the second driven roller 15*b*. An engaging portion 45 is provided at a leading end portion of the upper arm portion so that when the guide cover 37 is opened, a downstream end portion 38 of the guide cover 37 abuts against the engaging portion 45. With the guide cover 37 closed to allow the document to be conveyed, the lever member 41 is biased outward by the leaf spring 51, compressing the second driven roller 15*b* against the second driving roller 15*a*.

According to the configuration of the lever member 41 as described above, the engaging portion 45 is pressed against the document conveying path 11 to rotate the rotating support point 42 clockwise in the figure. The rotation of support point 42 moves the second driven roller 15*b* away from the second driving roller 15*a* toward the platen 1*a*. In conjunction with the movement of the second driven roller 15*b*, the leading end portion 34*a* of the guide member 25 slides on the platen 1*a* away from the guide plate 25. This forms the gap T between the guide plate 25 and the guide surface 33 through which a jammed document can be smoothly drawn out.

Figure 3:
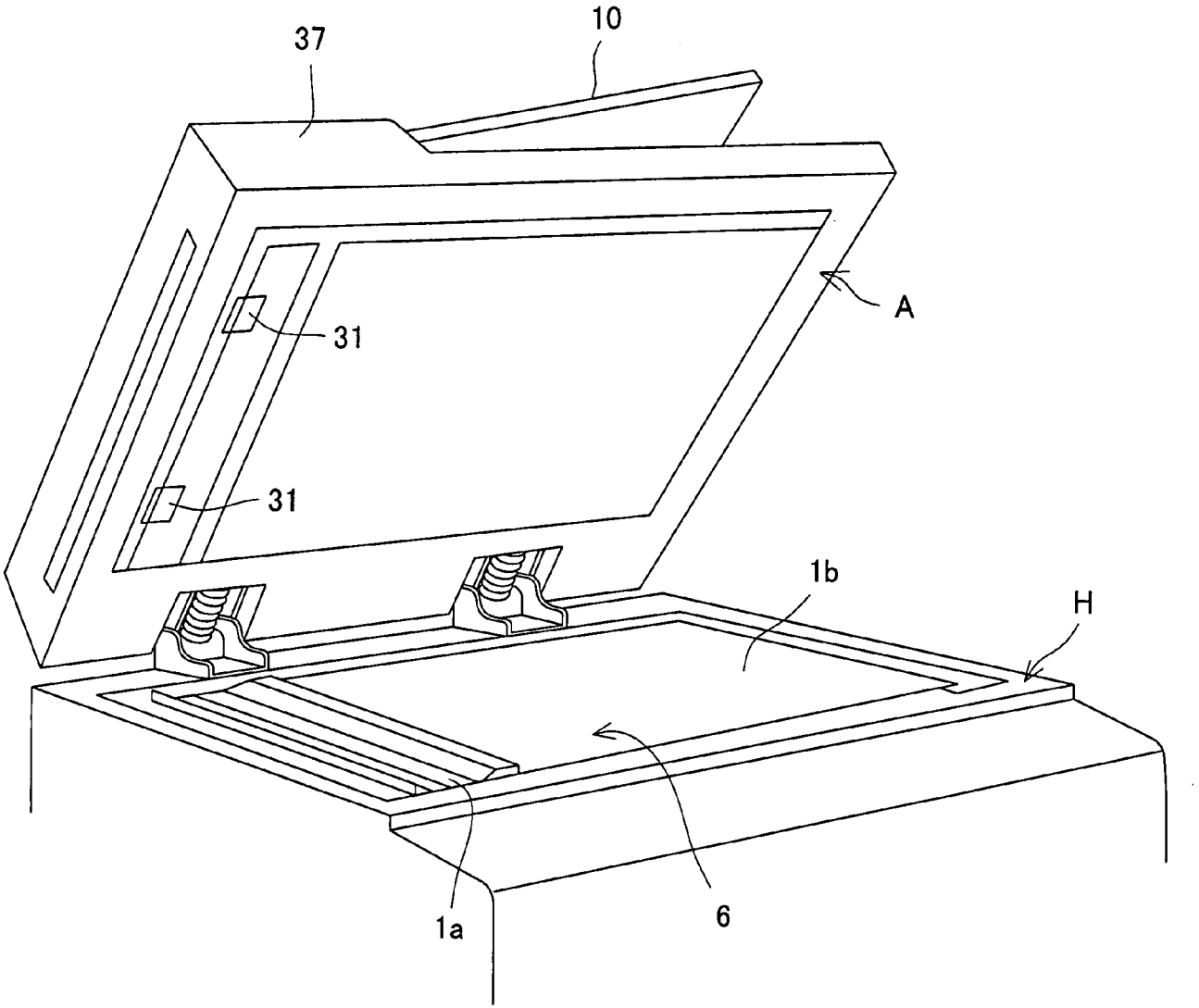
FIG. 3 is a perspective view of the document feeding device in which a guide cover is opened.

At least two second sheet feeding rollers 15 are provided above the platen 1*a* at equal intervals in a direction orthogonal to the document conveying direction. As shown in FIG. 3, a plurality of the guide members 31 is also arranged in association with the second driven roller 15*b*, constituting the second sheet feeding roller 15, to allow the document to be stably conveyed without being tilted.

A pair of guide plates is located downstream of the document reading position 21 of the platen 1*a*, and extends so as to incline obliquely upward in order to allow the document P subjected to an image reading process to pass through. The first sheet discharging roller 16 and the second sheet discharging roller 17 sequentially convey sheets to the sheet discharging tray 12.

Now, description will be given of an operation of conveying the sheet and an operation of removing the inappropriately conveyed (jammed) sheet which operations are performed by the document feeding device A configured as described above. As shown in FIG. 1, with the guide cover 37 closed, the first driving roller 14*a* of the first sheet feeding roller 14 nips the first driven roller 14*b* of the first sheet feeding roller 14. The second driving roller 15*a* of the second sheet feeding roller 15 nips the second driven roller 15*b* of the second sheet feeding roller 15. Documents delivered from the sheet feeding tray 10, one by one, by the delivery roller 13 are conveyed on the document conveying path 11 toward the platen 1*a* while being sandwiched between the first driving roller 14*a* and the first driven roller 14*b* and between the second driving roller 15*a* and the second driven roller 15*b*. Furthermore, the guide surfaces 33 of the guide members 31 are arranged opposite the second sheet feeding roller 15*a* and the guide plate 25, provided on a downward inclined part of the document conveying path which extends to an upstream end of the platen 1*a*. This allows the conveyed document to be smoothly fed out toward the platen 1*a* without sagging. Thus, images can be accurately read from sequentially conveyed documents at the document reading portion 21.

Figure 4:
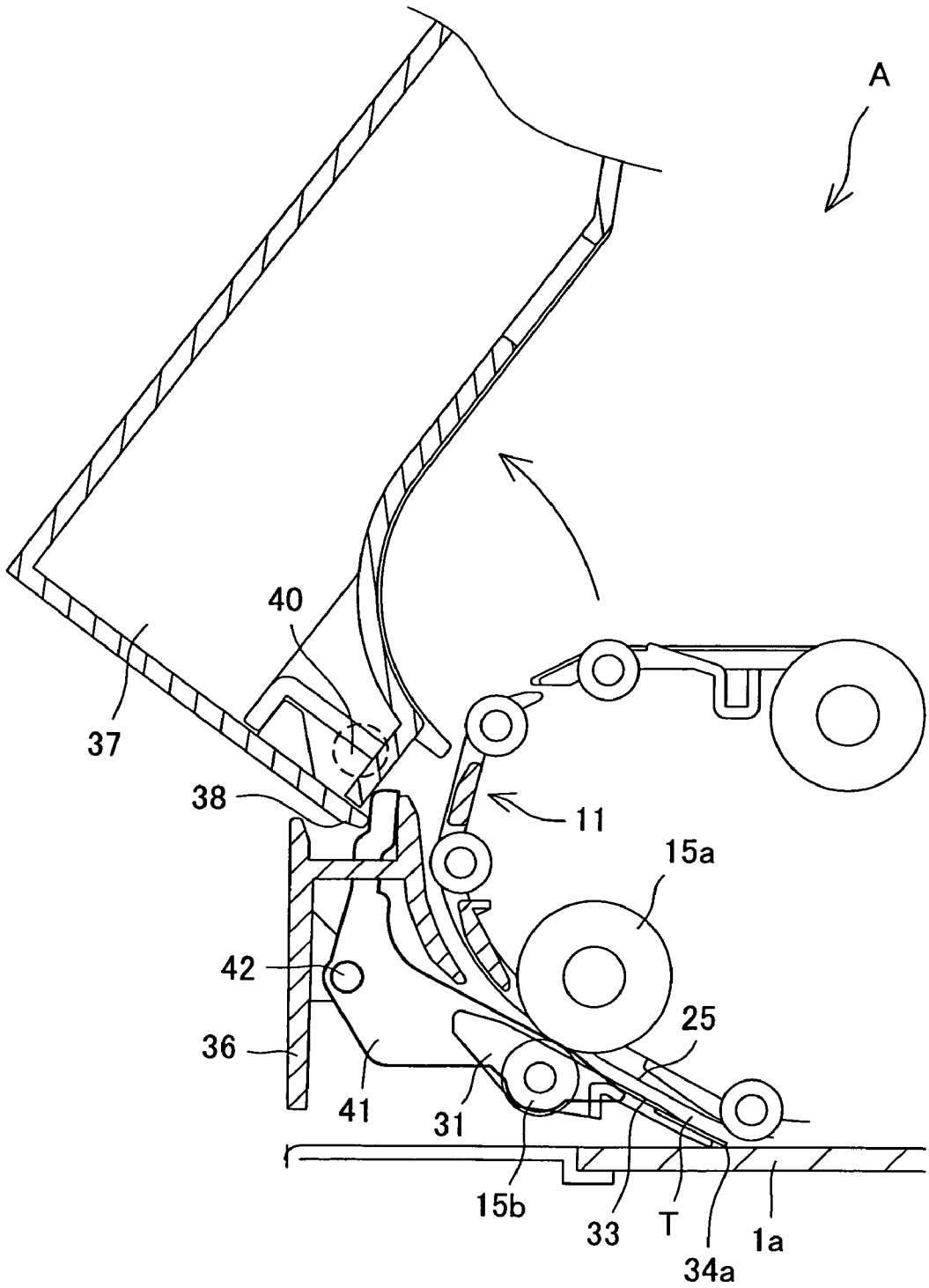
FIG. 4 is a diagram illustrating the start of an operation of opening the guide cover.
Figure 5:
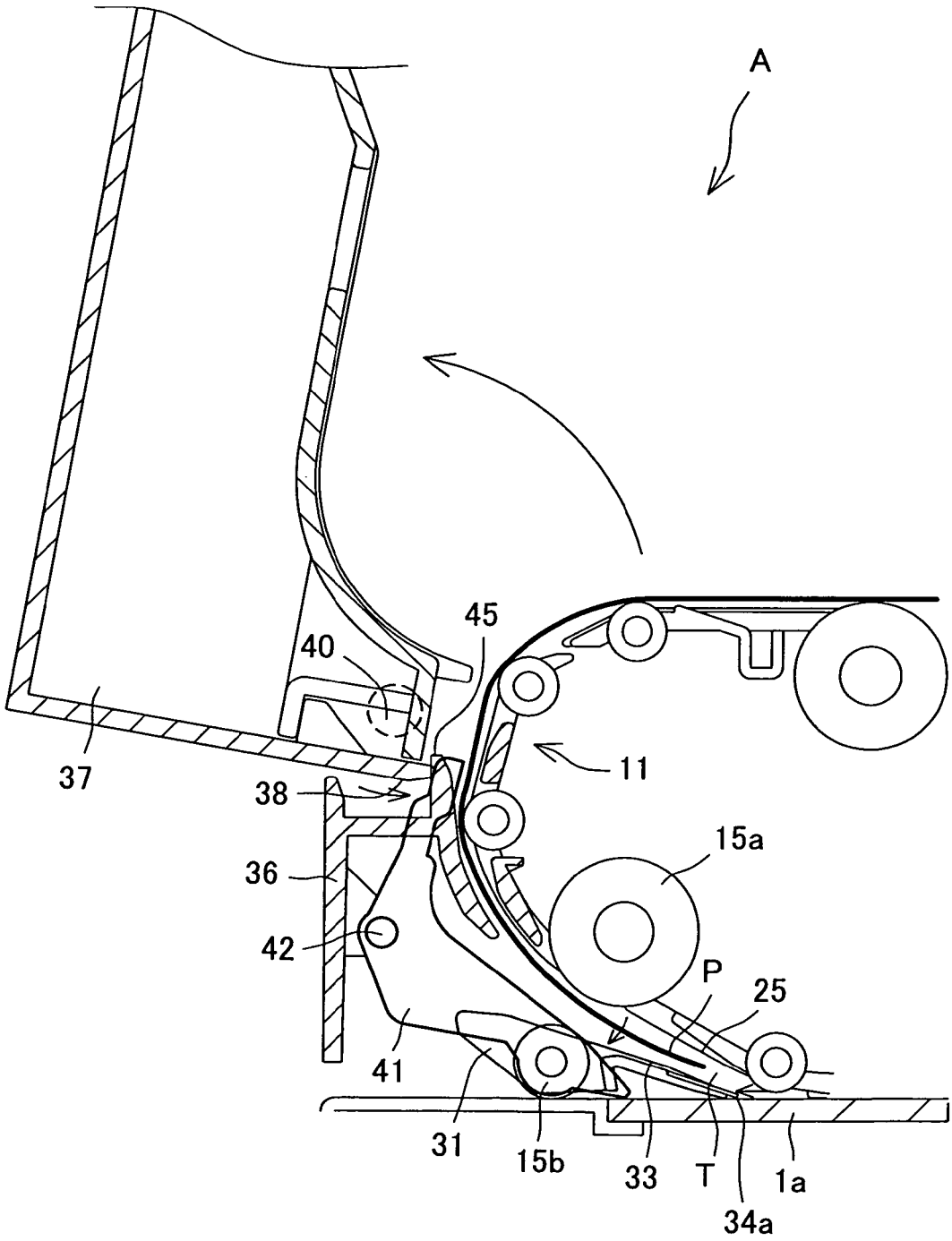
FIG. 5 is a diagram illustrating that guide members have been moved in conjunction with the operation of opening the guide cover.

On the other hand, if jam or the like occurs during conveyance of the document, the situation can be dealt with by opening the guide cover 37. This operation will be described below with reference to FIGS. 1, 4, and 5. When an upstream end portion 39 of the guide cover 37 is lifted so as to pivot around a rotating support point 40, provided on the side plate 36, the first driven roller 14*b* is separated from the first driving roller 14*a*. Furthermore, when the opening angle of the guide cover 37 is increased to raise the guide cover 37 to nearly 90 degrees, the downstream end portion 38 of the guide lever 37 abuts against the engaging portion 45 of the lever member 41 to rotate the lever member 41 around the rotating support point 42 clockwise in the figures. The rotation of the lever member 41 separates the second driven roller 15*b* supported at an end portion of the lower arm portion 43 by a shaft, downward from the second driving roller 15*a*.

In conjunction with the movement of the second driven roller 15*b*, the guide member 31 is separated downward from the guide plate 25. In conjunction with the movement of the second driven roller 15*b*, the guide member 31 slidably moves slightly leftward in the figures with the leading end portion 34*a* in contact with the top surface of the platen 1*a*. The sliding movement increases the gap T between the guide surface 33 and the guide plate 25. Thus, when the jammed document P is to be removed, not only the nipping between the first sheet feeding roller 14 and the second sheet feeding roller 15 can be cancelled but the guide member 31 guiding the document P along the shape of the document conveying path 11 can also be retracted. The document P remaining drawn onto the platen 1*a* can be easily removed without being damaged.

After the above-described operation is performed to remove the jammed document, an operation of closing the open guide cover 37 toward the sheet feeding tray 10 is started. Then, the downstream end portion 38 of the guide cover 37 is disengaged from the engaging portion 45. The lever member 41 is thus returned to the original rotating position by the bias force of the leaf spring 51, shown in FIG. 2. Thus, the second driven roller 15*b* is nipped by the second driving roller 15*a*. In conjunction with the second driven roller 15*b*, the guide member 31 also returns to and is fixed at the position where the gap is created between the guide member 31 and the guide plate 25. Moreover, the guide cover 37 is rotated toward the sheet feeding tray 10 and returned to the original position where the guide cover 37 covers the document conveying path 11. Then, the first driven roller 14*b*, located in the guide cover 37, is nipped by the first driving roller 14*a* to allow the document to be conveyed.

As described above, in the document feeding device A according to the present invention, the operation of opening the guide cover 37 makes it possible to open the narrow document conveying path 11 with the predetermined gap maintained. The document conveying path 11 is located at the position immediately in front of the platen 1*a*, which reads the image from the document. Thus, the document drawn onto the platen 1*a* to cause jamming can be easily and safely removed without being damaged. In particular, since the operation of opening or closing the guide cover 37 is transmitted to the guide member 31 via the lever member 41, the operation of moving the guide member 31 can be performed in the narrow space between the platen 1*a* and the second sheet feeding roller 15.

On the other hand, when the guide cover 37 is in a normal closed condition, the guide surfaces 33 of the guide members 31 are arranged along the part of the document conveying path which is located at the position immediately in front of the platen 1*a*. Thus, the document conveyed from the sheet feeding tray 10 can be smoothly fed out to the document reading position 21 of the platen 1*a*. Consequently, the image can be accurately read without misaligning the document surface.

The present application is based on, and claims priority to, Japanese Patent Application No. 2007-99651, filed on Apr. 5, 2007, the contents of which are incorporated herein by reference.

While the invention has been explained with reference to the specific embodiments of the invention, the explanation is illustrative, and the invention is limited only by the appended claims.

What is claimed is:

1. A document feeding device for conveying a document onto a reading position, comprising:

a sheet feeding tray;

an upstream guide member extending from the sheet feeding tray for guiding the document from the sheet feeding tray, said upstream guide member forming an upstream path of a document conveying path;

a downstream guide member extending from the upstream guide member for guiding the document from the upstream guide member onto the reading position;

an opposite guide member located opposite the downstream guide member, said opposite guide member forming a downstream part of the document conveying path;

a support member pivotally supporting the upstream guide member so that the upstream guide member is movable in a direction to open the document conveying path; and a guide moving device for slidably moving the downstream guide member away from the opposite guide member upon a pivoting opening operation of the upstream guide member, wherein the downstream guide member includes one end portion, and the guide moving device slidably moves the one end portion so that a guide surface of the downstream guide member is separated from the opposite guide member, and wherein the guide moving device comprises a lever member pivotally supported by a shaft and having an engaging portion engageable with a part of the upstream guide portion during opening of the upstream guide member and a rotating support portion pivotally supporting the other end portion of the downstream guide member.

2. The document feeding device according to claim 1, wherein the upstream guide member is integral with a cover member covering the upstream path of the document conveying path.

3. The document feeding device according to claim 1, further comprising a pair of conveying rollers located on the downstream part of the document conveying path, said conveying rollers conveying the document along the downstream guide member onto the reading position; and the guide moving device moves one of the conveying rollers away from the other roller.

4. The document feeding device according to claim 1, wherein the downstream guide member slidably moves while rotating away from the opposite guide member upon a pivoting operation of the lever member.

5. The document feeding device according to claim 4, wherein the lever member comprises an engaging portion for engaging a part of the upstream guide member, and the lever member engages a part of the upstream guide member to pivot.

6. The document feeding device according to claim 1, further comprising driving and driven rollers located on the downstream part of the document conveying path for conveying the document along the downstream guide member onto the reading position, said driven roller facing the driving roller and being arranged on the downstream guide member to move close to and away from the driving roller by the lever.

7. The document feeding device according to claim 6, further comprising a leaf spring for compressing the driven roller toward the driving roller when the upstream guide member is closed.

8. A document reading apparatus for reading a document, comprising:

a sheet feeding tray for receiving the document;

a reading platen for reading the document;

a sheet discharging tray located below the sheet feeding tray to house the read document;

a U-shaped document conveying path along which the document from the sheet feeding tray is guided toward the sheet discharging tray via the reading platen;

an upstream guide member which is an upstream part of the document conveying path;

a downstream guide member which is a downstream part of the document conveying path, said downstream guide member being located between the upstream guide member and the reading platen and inclined toward the reading platen;

an opposite guide member located opposite the downstream guide member;

a support member pivotally supporting the upstream guide member so that the upstream guide member is movable in a direction to open the upstream part of the document conveying path; and a guide moving device for slidably moving the downstream guide member away from the opposite guide member along the reading platen upon a pivoting operation of the upstream guide member, wherein the downstream guide member includes one end portion contacting a top surface of the reading platen, and the guide moving device slidably moves the one end portion on the reading platen so that a guide surface of the downstream guide member is separated from the opposite guide member, and wherein the guide moving device comprises a lever member pivotally supported by a shaft and having an engaging portion engageable with a part of the upstream guide portion during opening of the upstream guide member and a rotating support portion pivotally supporting the other end portion of the downstream guide member.

9. The document reading apparatus according to claim 8, wherein the upstream guide member is integral with a cover member covering the upstream part of the document conveying path.

10. The document reading apparatus according to claim 8, wherein a pair of conveying rollers is located on a part of the document conveying path located between the upstream guide member and the reading platen for conveying the document along the downstream guide member onto the reading platen, and the guide moving device moves one of the conveying rollers away from the other roller.

11. The document reading apparatus according to claim 8, further comprising a document reading apparatus main body comprising the reading platen on a top surface thereof;

wherein a document feeding device comprising the guide members, the sheet feeding tray, the sheet discharging tray, and the document conveying path are provided above the document reading apparatus main body, and the document feeding device is mounted so as to be freely opened and closed with respect to the top surface of the document reading apparatus main body, and the downstream guide member includes one end portion contacting the reading platen.

* * * * *